US006311438B1

(12) United States Patent
Haquette

(10) Patent No.: US 6,311,438 B1
(45) Date of Patent: Nov. 6, 2001

(54) SILO FOR THE STORAGE OF POWDERY PRODUCTS HAVING A VIBRATING BOTTOM

(75) Inventor: Michel Haquette, Gondecourt (FR)

(73) Assignee: Industries Services et Conseils I.S.E.R.C.O., Gondecourt (FR)

( * ) Notice: Subject to any disclaimer, the term of this patent is extended or adjusted under 35 U.S.C. 154(b) by 0 days.

(21) Appl. No.: 09/568,154

(22) Filed: May 10, 2000

(51) Int. Cl.[7] ..... E04H 7/00
(52) U.S. Cl. ..... 52/192; 52/63; 222/199
(58) Field of Search ..... 52/192, 195, 197, 52/378; 222/196, 199, 200

(56) References Cited

U.S. PATENT DOCUMENTS 3,712,002 * 1/1973 Hillinger et al. ..... 52/63
3,853,247 * 12/1974 Wahl ..... 222/199
4,520,952 * 6/1985 Wahl et al. ..... 222/199

* cited by examiner

*Primary Examiner*—Carl D. Friedman
*Assistant Examiner*—Steve Varner

(57) ABSTRACT

A silo (1), in particular a vertical one, designed to store products in powder form, and having a vibrating bottom (3), suitable for favoring flow, and for equipping a fixing damper body (2) of a silo (1) by means of a joining element (9) and a fixing damper (10), provided to ensure a tight connection between the body of the silo and the vibrating bottom, while, at the same time, preventing a transmission of vibrations from one to the other.

According to the invention, the joining element (9) takes the form of an elastically deformable, peripheral, self-supporting joint, interposed directly and freely between the body (2) of the silo (1) and the vibrating bottom (3), cooperating with the fixing damper (10) to perform both a sealing function and a damping function, without discontinuity over its entire bearing periphery.

10 Claims, 2 Drawing Sheets

SILO FOR THE STORAGE OF POWDERY PRODUCTS HAVING A VIBRATING BOTTOM

BACKGROUND OF THE INVENTION

1. Field of the Invention

The present invention relates to a silo, in particular a vertical one, designed to store products in powder form, and having a vibrating bottom, in particular one of a frustoconical shape, suitable for favoring the flow of the material.

Although more especially developed in connection with the silo storage of finely ground powder, the invention will also find an application in all sectors of industrial activity in which there is a need to have material kept from spontaneous discharge solely through the effect of gravity transported in containers, hoppers or the like.

2. Description of the Related Art

When solid products such as, in particular, flours or talc having a grain size of less than one millimeter are stored in silos, the force of gravity does not spontaneously cause the products to flow.

Such powders, which are subjected to the pressure exerted by their own weight, form, form a vault, in the lower portion of the silo, which is generally frustoconical in shape. The vault blocks the lower orifice of the silo through which the powder ought to flow.

Thus, if it is wished to extract material from the silo, the first thing to be done is to break down the vault formed by the product in powder form.

In this respect, one of the known techniques is to place, in the portion of the cone of the silo in which the vault forms, an element known as a 'vibrating bottom'.

This element can further be internally equipped with a central deflector absorbing the static loads of the product stored in the silo, in particular the pressure due to its weight.

This being the case, to enable the material to flow by breaking down the vault, the entire bottom of the silo and, more precisely, its outer envelope, are caused to vibrate by means of an unbalanced motor.

This vibration, which diffuses through the stored product, enables the particles to shift in relation to one another and thus transition from the friction state to the sliding state. These changes of state facllitate flow.

With this type of equipment, it is necessary to prevent the vibrations of the frustoconical element at the bottom of the silo equipped with a vibrating bottom from being transmitted to the rest of the silo body.

Over widely diffused vibration in the bottom portion of the stored products can, in fact, lead to the settling, or agglomeration, of the solid products throughout the silo, which would be counter to the object of the exercise.

For this purpose, it is known to use a vibrating bottom comprising a plane, peripheral, upper rim, provided opposite a corresponding lower rim of the silo, with a view to their connection, this being accomplished via a relatively flexible connecting and damping element, cooperating with independent connecting means interposed between said lower and upper rims, in such a way as to ensure a tight connection between the silo and its vibrating bottom while, at the same time, preventing vibrations from being transmitted from one to the other.

In one type of known equipment, the connecting, or joining, element takes the form of a peripheral joint with a U-shaped cross-section, opening outwardly and interposed between the bottom portion of the silo and the vibrating bottom. The joining element, the bottom portion of the silo and the vibrating bottom are connected via two flat flanges, independent of one another, designed to be mounted against the upper and lower horizontal wings of the U-shaped joint to press them against the lower and upper rims.

In this device, once the joint is in position between the respective peripheral rims of the bottom portion of the silo and of the vibrating bottom, it is fixed by means of two series of bolts, placed close together and passing equidistantly through each of the peripheral rims, to cooperate by clamping with each of the flanges after passing through the horizontal wings of the U-shaped joint and thus clasp it in place.

The installation of such a known joint in fact only ensures tightness between the bottom portion of the silo and the vibrating bottom.

More specifically, the vibrating bottom is fixed in relation to the silo, and the vibrations are damped, via four silentblocs, or shock mounts, diametrically opposed two by two, cooperating with four support points provided on the lower rim of the silo, opposite four other support points provided on the upper rim of the vibrating bottom.

In this known device, the entire weight of the vibrating bottom, and of any product that may be contained therein, is thus borne by the four shock mounts.

To provide and implement this technique on the silo adds to the cost of the latter and, what is more, stresses are consequently localized at four points only, which necessitates reinforcement, in particular by means of gusset plates mounted around the lower portion of the silo, and thick metal plating.

Furthermore, with this same device, it is necessary to provide two independent flanges, which represent additional parts, necessitating special Installation, thus leading to increased labor requirements.

BRIEF SUMMARY OF THE INVENTION

The object of the present invention is to overcome these drawbacks and provides, for this purpose, a silo, in particular a vertical one, designed to store products in powder form, and having a vibrating bottom, suitable for favoring flow, and for equipping the body of the silo by means of a joining element and of fixing damper, provided to ensure a tight connection between the body of the silo and the vibrating bottom, while, at the same time, preventing the transmission of vibrations from one to the other, wherein the joining element takes the form of an elastically deformable, peripheral, self-supporting joint, interposed directly and freely between the body of the silo and the vibrating bottom, cooperating with the fixing damper to perform both a sealing function and a damping function, without discontinuity over its entire bearing periphery.

The advantages procured by the invention are thus the possibility of dispensing with the aforementioned flanges, hence their mounting, uniform distribution of forces, the possibility of using thinner sheet metal, in particular to construct the vibrating bottom, and uniform flexibility of the joint ensuring uniform distribution of vibrations.

The present invention also relates to the characteristics that will emerge in the course of the following description, and which are to be considered either in isolation or in all their possible technical combinations.

BRIEF DESCRIPTION OF THE SEVERAL VIEWS OF THE DRAWINGS

This description, which is given by way of a non-limitative example, will make it easier to understand how the invention can be implemented with reference to the annexed drawings.

DETAILED DESCRIPTION OF THE INVENTION

Figure 1:
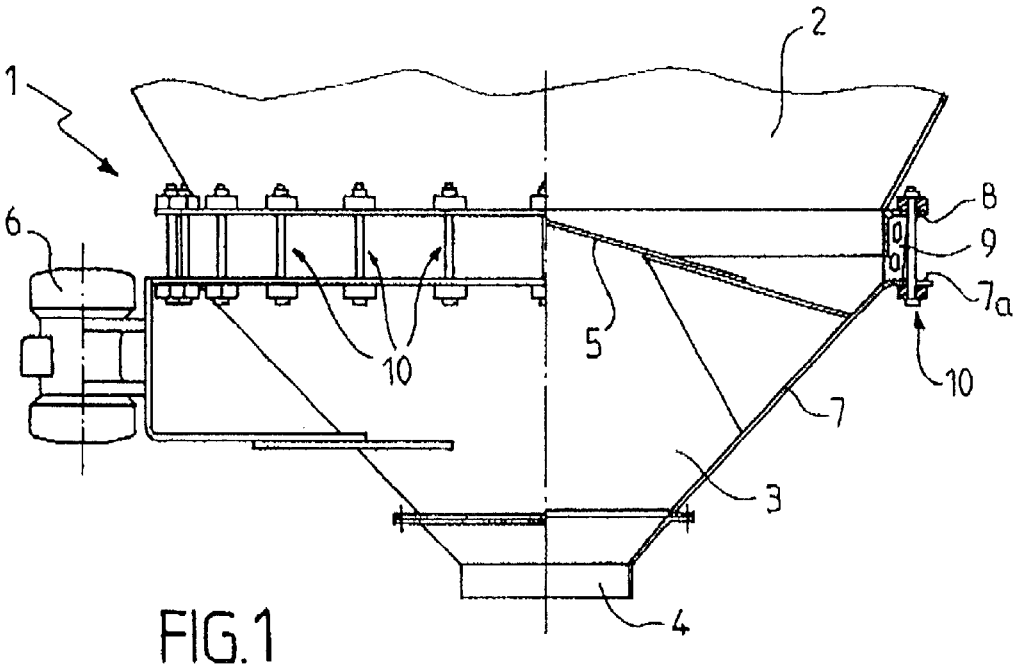
FIG. 1 is a plan view, half in cross-section, of the lower portion of a silo provided with a vibrating bottom, according to the invention.

FIG. 1 illustrates the lower portion of a body 2 of a silo 1, in particular having a vertical axis and a cross-section of a cylindrical or other shape, forming the area for storage of materials in powder form, equipped with a vibrating bottom 3.

The silo 1 can also be provided with feet by which it is secured to the floor or ground.

Vibrating bottom 3 has a matching cross-section to prolong and equip silo 1. It also has, on its lower portion, a discharge orifice 4, through which the material can flow.

To favor the flow of the products in powder form, vibrating bottom 3 is constituted by an outer envelope 7, in particular frustoconical in shape, and, as applicable, by an inner central deflector 5 taking the form, of a counter-cone.

Vibrating bottom 3 comprises, in particular, an unbalanced motor mechanism 6.

Such a silo arrangement, as well as such unbalanced motor mechanism, are known to one skilled in art.

As can be seen from the figures, shell 7 of vibrating bottom 3 comprises a planar peripheral upper rim $\mathbf{7}_a$, provided opposite a corresponding lower rim 8 of the silo, with a view to their assembly. Connection takes place via a joining element 9 and fixing damper 10, designed to be interposed between the two planes $\mathbf{7}_a$, 8 so as to ensure both a tight connection between the body 2 of silo 1 and vibrating bottom 3, while, at the same time, preventing vibrations from being transmitted from one to the other.

According to the invention, joining element 9 takes the form of an elastically deformable peripheral self-supporting joint, directly and freely interposed between the body of silo 1 and vibrating bottom 3, in particular lower rim 8 and upper rim $\mathbf{7}_a$, respectively.

Self-supporting joint 9 cooperates with the fixing damper means 10 and is, in particular, held in position by a plurality of fixing elements 10 interposed between the rims 8 and $\mathbf{7}_a$, the joint performing both a sealing function and a damping function, without discontinuity over its entire bearing periphery.

Figure 2:
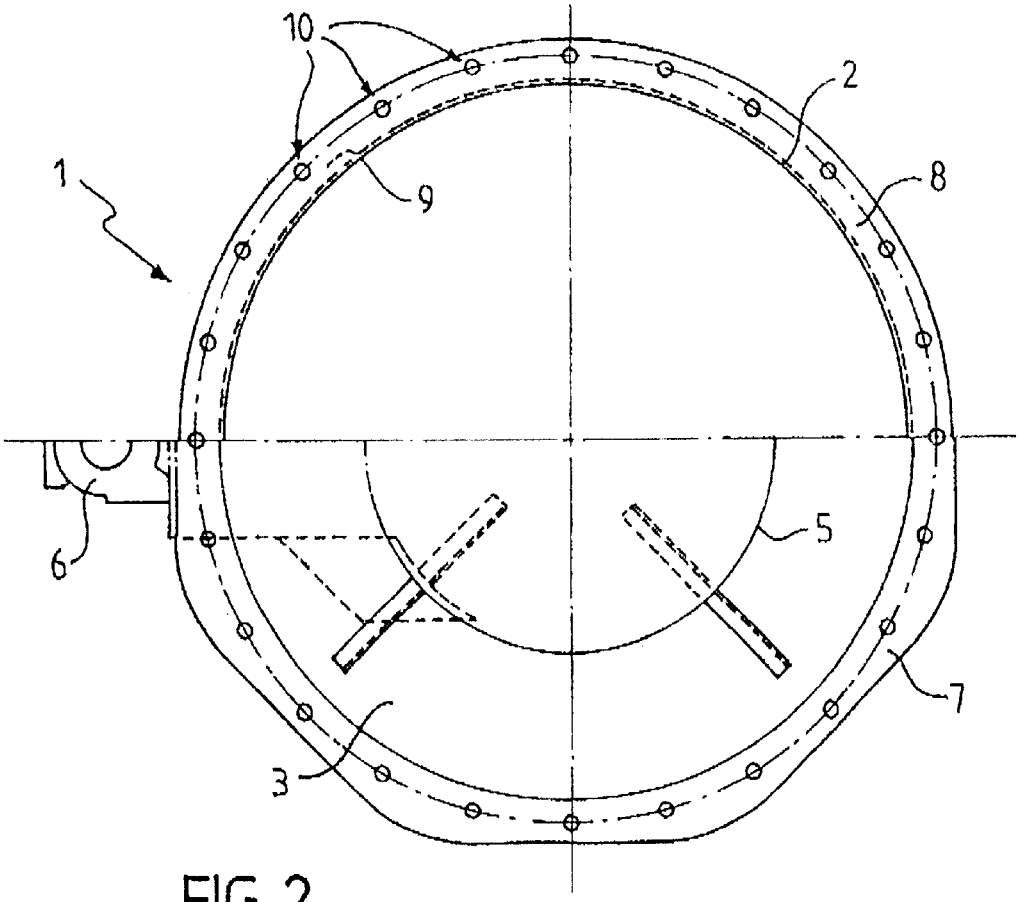
FIG. 2 is a top view according to FIG. 1.
Figure 3:
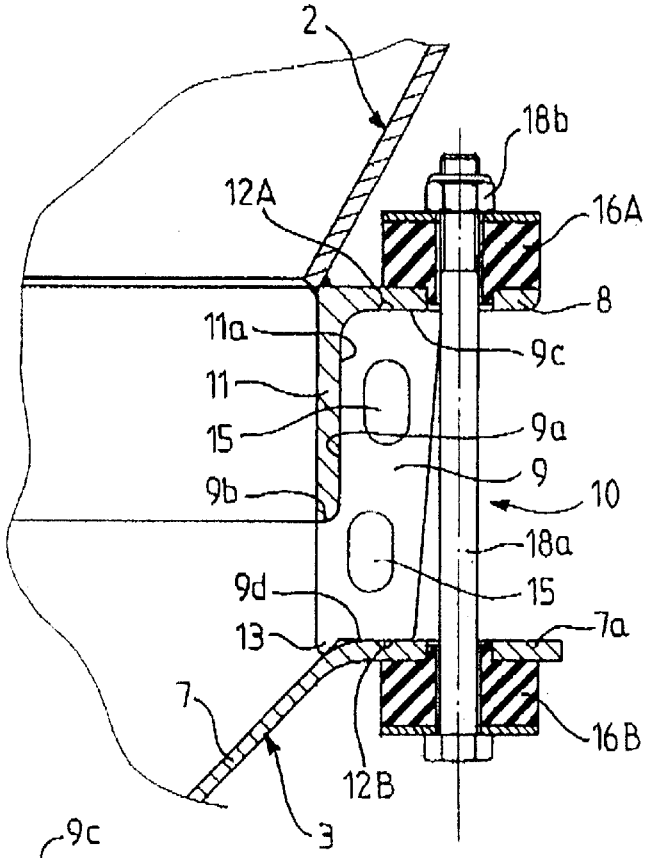
FIG. 3 is a larger-scale cross-sectional view of the connector according to the invention, between the silo and the vibrating bottom.

As particularly clearly illustrated in FIG. 2, the upper and lower rims, 8 and $\mathbf{7}_a$, respectively, of silo 1 and of vibrating bottom 3, which are constituted, in particular, by flanges, or collars, are located in substantially parallel spaced planes and are traversed perpendicularly, in such a way that they are uniformly distributed over their periphery, by fixing damper means 10 in order to ensure the connection of vibrating bottom 3 to silo 1, while, at the same time, circumscribing self-supporting joint 9, to retain it in the space defined by the upper rim 8 and lower rim $\mathbf{7}_a$.

According to one advantageous form of embodiment, lower rim 8, in particular in the form of a collar, has, starting from its inner periphery, a cylindrical turned-down edge forming a ring, against the outer wall 11*a* of which concentrically bears a corresponding inner wall of self-supporting joint 9, so as to confine the latter, between the ring 11 and fixing damper 10, in a horizontal plane, and between the two rims, 8 and $\mathbf{7}_a$, along a vertical axis.

Furthermore, self-supporting joint 9 has, in an upper area of its inner peripheral wall, a concentrically recessed portion, 9*a*, designed to cooperate with the lower portion of body 2 of the silo, and, in particular, with ring 11, and axially delimited by a shoulder 9*b*, which is also peripheral, constituting an abutment for the ring 11.

According to another characteristic of self-supporting joint 9, the latter has an upper plane 9*c* and a lower plane 9*d* constituting means for bearing, respectively, on lower rim 8 of silo 1 and on upper rim $\mathbf{7}_a$ of vibrating bottom 3, said upper plane $\mathbf{9}_c$ and lower plane $^{9}{}_d$ comprising a concentric lip 12A and 12B designed to be elastically crushed when joint 9 is mounted and fixing damper means 10 are put into place.

According to another characteristic of self-supporting joint 9, lower plane $\mathbf{9}_d$ thereof has a concentric protuberance 13 provided on its inner edge, designed to cooperate with edge 7–$\mathbf{7}_a$ of silo bottom 3, forming, in particular, with said plane, an angle substantially equal to that formed by collar $\mathbf{7}_a$ with its frustoconical wall, and designed to mate with upper rim $\mathbf{7}_a$ of vibrating bottom 3 so as to fit over it upon assembly.

To improve its fit around ring 11, upper plane 9*c* of self-supporting joint 9 is linked to its recessed peripheral portion 9*a* by a cant 14, likewise peripheral.

According to another characteristic of the invention, the body of the elastically deformable material constituting self-supporting joint 9 is recessed to produce peripheral channels 15 the number, shape and dimensions of which are such as to impart to it a power of flexibility and retention, or set, in relation to its strength, according to a chosen, predetermined compromise.

In particular, the height of the joint will be designed to permit a satisfactory compromise between flexibility and compression, whereas its width will contribute to the strength of the self-supporting joint.

The elastically deformable material constituting self-supporting joint 9 will be selected from among elastomers such as a propylene ethylene mixture.

In both cases, tests have shown that excellent results are obtained with a Shore hardness of 70 ±20%.

Advantageously, self-supporting joint 9, obtained from an elastically deformable material, is produced by extrusion.

According to another characteristic of the invention fixing damper 10 for fixing vibrating bottom 3 to silo 1 and damping are constituted by a plurality of bolts bearing on either side, in particular, of collars 8 and $\mathbf{7}_8$. Furthermore, upon mounting, a controlled tightening force is exerted on the bolts in order to obtain, in service, pre-stressing of the joint according to a value predetermined as a function of the degree of damping wished.

It should be noted that this method mounting makes it possible to provide for fixing the different elements with maximum precision and reduces the torsional moment generated in the area of upper collar 8 and lower collar $\mathbf{7}_a$, which makes it possible to schedule a reduction in the thickness of the sheet metal of which they are formed.

According to another characteristic of the invention, screw heads 18*a* and nuts 18*b*, forming bolts 18, are brought to bear via washers 16A, 16B made of elastomer and interposed between screw heads 18*a* and nuts 18*b*, on one hand, and, in particular, upper collar $7_a$ of vibrating bottom 3, and, in particular, lower collar 8 of body 2 of silo 1, on the other hand, so as to contribute to the damping effect imparted by self-supporting joint 9 and to serve as a brake preventing the bolts from being slackened.

Figure 4:
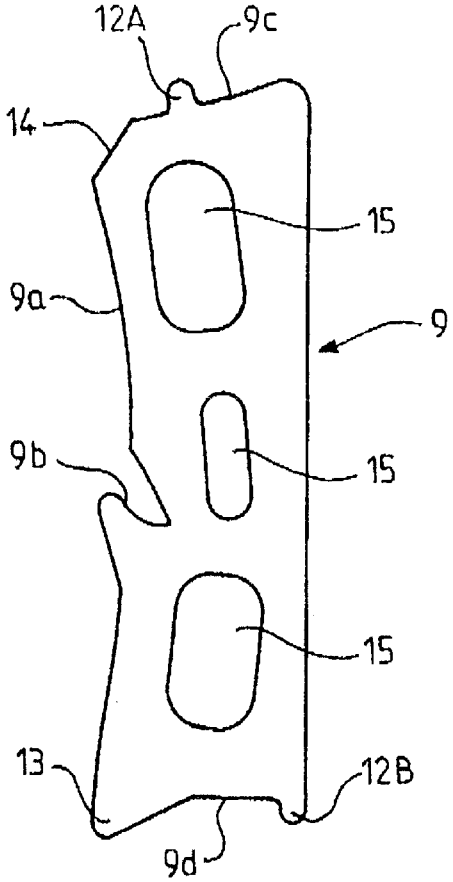
FIG. 4 is a sectional view of a self-supporting joint according to the invention, shown in rest condition.

It goes without saying that the profile shown in FIG. 4 is simply an illustrative example and that this section could be of any other shape.

A self-supporting joint according to the invention could also, indeed, be constituted by an O ring, or have a square, rectangular, recessed or non-recessed section.

Similarly, as to its structure, it can be constituted by any other material, on condition that it be elastically deformable and capable of constituting a self-supporting joint.

What is claimed is:

1. A silo for storing products of powder form comprising:

a body having a rim affixed adjacent a bottom thereof;

a vibrating bottom having a planar rim adjacent an upper end therof, said planar rim extending around a periphery of said vibrating bottom in parallel relation to said rim of said body;

a joining element interposed directly and freely between said bottom of said body and said vibrating bottom, said joining element being an elastically deformable and extending around a periphery of said bottom of said body, said joining element being self-supporting between said body and said vibrating bottom, said joining element having an upper planar surface and a lower planar surface, said upper planar bearing surface against said rim of said body, said lower planar surface bearing against said planar rim of said vibrating bottom; and a damping means cooperative with said joining element for providing an airtight sealing connection between said body and said vibrating bottom and for damping vibrations from said vibrating body to said body, said damping mans being distributed uniformly around said rim of said body and said planar rim of said vibrating bottom, said damping means comprising a plurality of bolts and a plurality of washers, each of said plurality of washers received on respective bolts of said plurality of bolts, said plurality of washers bearing against said planar rim of said vibrating bottom and against said rim of said body so as to prevent said plurality of bolts from being slackened.

2. The silo of claim 1, said planar rim of said vibrating bottom and said rim of said body being traversed perpendicularly by said damping means, said damping means abutting said joining element for retaining and joining element in a space between said planar rim of said vibrating bottom and said rim of said body.

3. The silo of claim 2, said rim of said body having a cylindrical vertically downwardly extending surface defining a ring, said ring having an outer wall bearing against an inner wall of said joining element so as to confine said joining element between said ring and said damping means and between said rim of said body and said planar rim of said vibrating body.

4. The silo of claim 3, said inner wall of said joining element having a concentrically recessed portion in an upper area thereof, said recessed portion being cooperative with said ring, said joining element having a shoulder formed below said recessed portion, said shoulder abutting a bottom of said ring.

5. The silo of claim 2, said upper planar surface of said joining element having a concentric lip elastically compressed against said rim of said body, said lower planar surface of said joining element having a concentric lip elastically compressed against said planar rim of said vibrating bottom.

6. The silo of claim 5, said lower planar surface of said joining element having a concentric protuberance formed along an inner edge thereof, said protubence abutting a surface of said planar rim and a frustoconical wall of said vibrating bottom.

7. The silo of claim 1, said joining element having a plurality of channels formed interior thereof.

8. The silo of claim 1, said joining element being formed of an elastomer having a shore hardness of 70±20%.

9. The silo of claim 1, said plurality of bolts being tightened so as to have a desired compressive force against said rim of said body and said planar rim of said vibrating body.

10. The silo of claim 9, said plurality of bolts each having a head and a nut, each of said plurality of washers being of an elastomeric material, one of said plurality of washers bearing against said rim of said body and one of said nut and said head, another of said plurality of washers bearing against said planar rim of said vibrating bottom and one of said nut and said head.

* * * * *